US005984754A

United States Patent [19]

Freelander

[11] Patent Number: 5,984,754

[45] Date of Patent: Nov. 16, 1999

[54] ILLUMINATED TOY PAIL

[76] Inventor: Michael S. Freelander, 46 Whisper Dr., Worcester, Mass. 01609

[21] Appl. No.: 08/756,901

[22] Filed: Dec. 2, 1996

[51] Int. Cl.[6] ..... A63H 33/22; F21K 2/06; F21V 33/00

[52] U.S. Cl. ..... 446/73; 446/219; 446/485; 362/34; 362/154

[58] Field of Search ..... 446/73, 219, 485; 362/34, 154, 156

[56] References Cited

U.S. PATENT DOCUMENTS

| | | | |
|---|---|---|---|
| 691,036 | 1/1902 | Williams | 362/154 |
| 2,428,133 | 9/1947 | Yogan | 446/485 |
| 4,563,726 | 1/1986 | Newcomb et al. | 362/34 |
| 4,652,980 | 3/1987 | Segan | 362/86 |
| 4,698,732 | 10/1987 | Hickey | 362/154 |
| 4,714,985 | 12/1987 | Hickey | 362/154 |
| 4,802,071 | 1/1989 | Schuster | 362/154 |
| 4,926,296 | 5/1990 | Blume et al. | 362/156 |
| 4,962,907 | 10/1990 | Gary | 248/205.3 |
| 5,008,780 | 4/1991 | Pennington-Ridge | 362/34 |
| 5,597,230 | 1/1997 | Newman | 362/154 |

*Primary Examiner*—Robert A. Hafer
*Assistant Examiner*—Laura Fossum
*Attorney, Agent, or Firm*—Salter & Michaelson

[57] ABSTRACT

An illuminated toy pail includes a translucent pail body, a handle attached to the pail body, and a retainer affixed to the interior of the pail body which is effective for holding a chemical light stick within the interior of the pail body. The bottom of the retainer includes a press-fit flange which is press fit into a pre-formed hole in the bottom wall of the pail body, and the top of the retainer includes a vertical bore which releasably receives and holds the light stick in a vertical orientation within the interior of the pail. The activated chemical light sticks can be easily inserted into the pail to illuminate the pail, thereby providing both novelty and safety aspects to the pail. When used, for example, in a Halloween, pumpkin-shaped pail body, the light causes the translucent pail body to glow as if a candle were lighted inside the pumpkin, provides a small amount of light to illuminate the ground below, and provides a highly visible, lighted safety indicator for passing vehicles.

3 Claims, 2 Drawing Sheets

ILLUMINATED TOY PAIL

BACKGROUND AND SUMMARY OF THE INVENTION

The instant invention relates to toy pails and buckets which are primarily utilized during holidays, such as Halloween, for collecting candy, and more particularly to a toy pail which is illuminated for both novelty and safety purposes.

Toy pails and buckets having a Halloween, or other holiday, theme are well known in the novelty toy arts. For example, many different manufacturers produce pumpkin shaped pails which children utilize to carry candy during their Halloween trick or treat travels.

The instant invention provides an illuminated toy pail comprising a translucent plastic pail body, a carrying handle attached to the pail body, and a retainer affixed to the interior of the pail body for releasably holding a light source within the interior of the pail body. In the preferred embodiment of the invention, the light preferably comprises a chemical light stick which produces a soft glowing light, and the retainer comprises a cup-shaped body which is affixed to the bottom wall of the pail body. The retainer includes a press-fit flange which is press fit into a pre-formed hole in the bottom wall of the pail body, and further includes an upwardly open vertically disposed bore which releasably receives and holds the chemical light stick in a vertical orientation within the interior of the pail. The activated chemical light stick is inserted into bore in the retainer to illuminate the pail body, thereby providing both novelty and safety aspects to the pail. When used in a Halloween, pumpkin-shaped pail body, the light causes the translucent pail body to glow as if a candle were lighted inside the pumpkin, provides a small amount of light to illuminate the ground below, and provides a lighted safety indicator for passing vehicles.

Accordingly, among the objects of the instant invention are: the provision of an illuminated toy pail; the provision of a retainer element for a light source which is releasably mounted within the interior of a pail body; and the provision of an illuminated toy pail including a retainer for retaining a chemical light stick within the interior of the pail.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
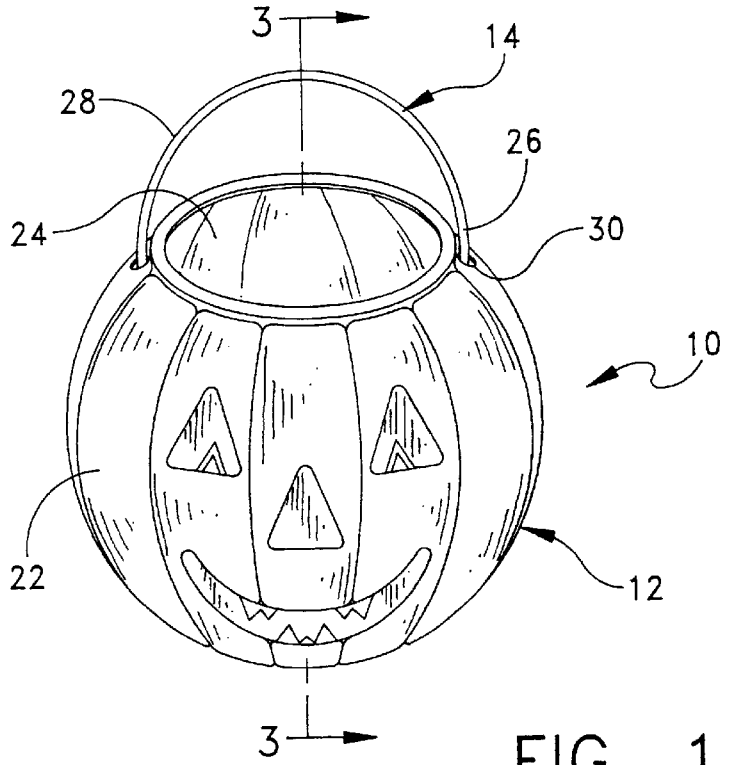
FIG. 1 is a perspective view of the instant toy pail.
Figure 2:
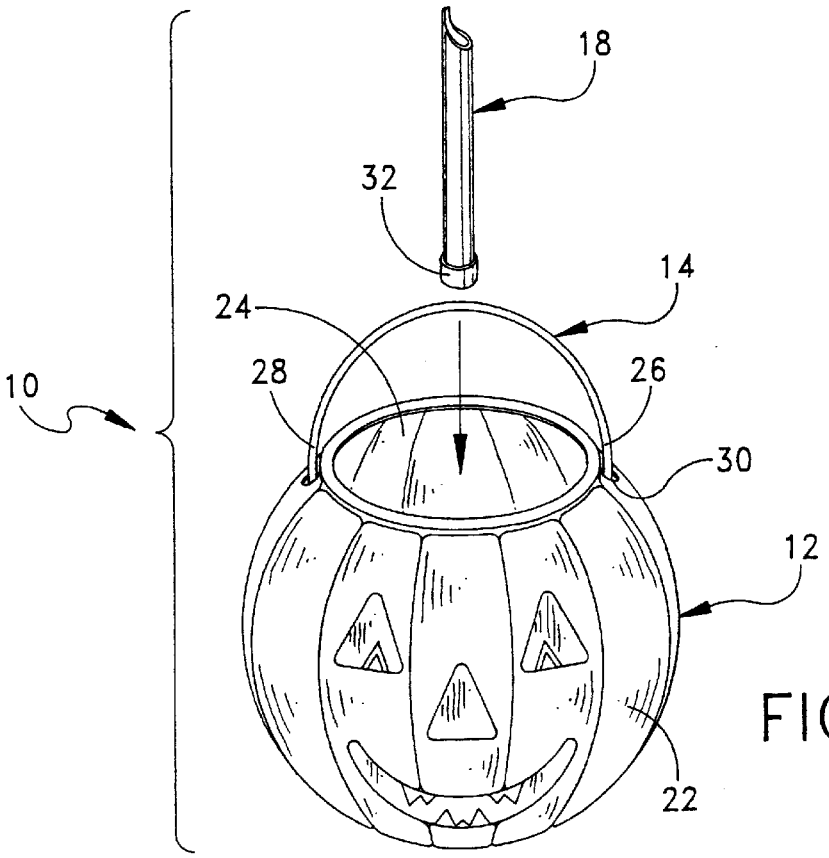
FIG. 2 is a partially exploded perspective view thereof showing the chemical light stick.

Referring now to the drawings, the illuminated toy pail of the instant invention is illustrated and generally indicated at 10 in FIGS. 1–2. As will hereinafter be more fully described, the instant toy pail 10 is illuminated to provide light for the child when carrying the pail 10, and to provide visibility to the child to passing vehicles.

Figure 3:
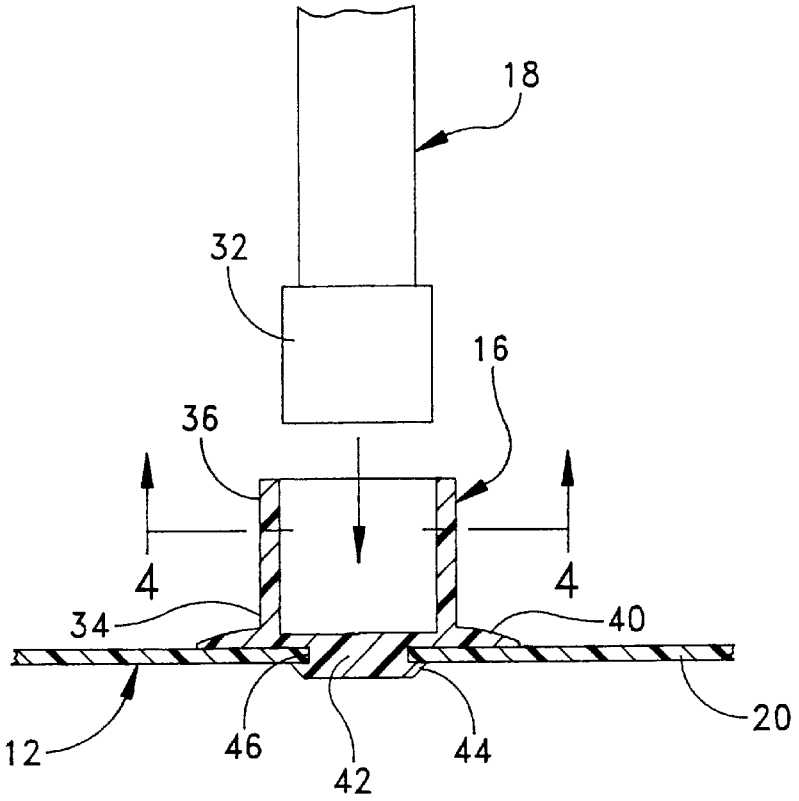
FIG. 3 is an enlarged, fragmentary, cross-sectional view thereof taken along line 3—3 of FIG. 1 showing the particular features of the retainer element.

The illuminated toy pail 10 comprises a translucent pail body generally indicated at 12, a carrying handle generally indicated at 14 attached to the pail body 12, and a retainer generally indicated at 16 (FIGS. 3–4) affixed to the interior of the pail body 12 which is effective for releasably holding a light source generally indicated at 18 within the interior of the pail body 12.

The translucent pail body 12 is preferably molded as a single entity from a translucent plastic material, and preferably is fashioned in the shape of an item symbolizing a holiday theme, such as a pumpkin, or cauldron, for a Halloween trick-or-treat theme. The pail body 12 includes a bottom wall 20 (FIG. 3) and a side wall 22 which cooperate to define an interior space 24 which is intended to hold candy, or other desired items. As illustrated in FIGS. 1 and 2, the side wall 22 is provided with fanciful markings and contours so that the pail body 12 resembles a pumpkin.

The carrying handle 14 has first and second ends 26, 28 respectively, which are attached to the side wall 22 of the pail body 12 in a conventional manner. For example, the ends 26, 28 of the handle 14 can be enlarged and received through holes 30 (one shown) in the side wall 22 of the pail body 12.

Since the primary intention of the illuminated pail 10 is to carry candy during Halloween trick or treating, the light source 18 preferably comprises a low-power light source which will not generate any significant amount of heat. Any light 18 which generates a significant amount of heat would present a safety problem, as well as the fact that it would melt the candy. In this regard, the light source 18 preferably comprises a chemical light stick, such as produced by American Cyanamid Corporation, Chemical Light Division, Wayne, N.J. The light stick is generally elongate in shape, and includes a cylindrical bottom end 32.

Figure 4:
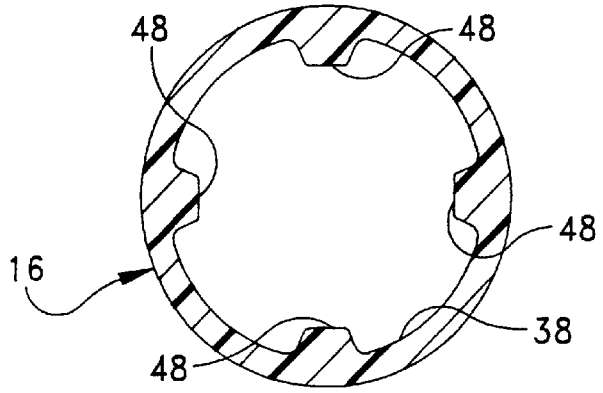
FIG. 4 is a cross-sectional view of the retainer taken along line 4—4 of FIG. 3.

The retainer 16 is specifically adapted to be affixed to the bottom wall 20 of the pail body 12, and to hold the bottom end 32 of the chemical light stick 18. More specifically, the retainer 16 is a generally cup-shaped body including a bottom portion 34 which is affixed to the bottom wall 22 of the pail body 12 and a top portion 36 having a vertical bore 38 which releasably receives and holds the bottom end 32 of the chemical light stick 18. The retainer 16 may be integrally molded with the pail body 12, or it may be molded as a separate piece wherein the bottom 34 of the retainer 16 and the bottom wall 22 of the pail body 12 include interfitting formations for releasable assembly of the retainer 16 with the pail body 12. In this regard, the present embodiment as illustrated includes an upper circular flange 40 which engages the inner surface of the bottom wall 22, and a lower circular press-fit flange 42. The press-fit flange 42 includes a protruding lip 44 which is press fit through a pre-formed hole 46 to engage the outer surface of the bottom wall 22 of the pail body 12. Referring to FIG. 4, the inner wall which defines the bore 38 is provided with four radially inwardly extending ridges 48 which frictionally and releasably engage only selected portions of the bottom end 32 of the light stick 18. While a specific embodiment of the retainer 16 is illustrated and described herein, it will be manifest to those skilled in the art that other arrangements of interfitting formations, and the retainer itself, are possible within the scope of the invention.

In use, the activated chemical light stick 18 is inserted into bore 38 in the retainer to illuminate the pail body 12, thereby providing both novelty and safety aspects to the pail 10.

When the light stick 18 has expended its chemical energy, the light stick 18 may be removed and replaced with another light stick 18.

It can therefore be seen that the instant invention provides a novel and useful toy pail 10. When used, for example, in a Halloween, pumpkin-shaped pail body 12, the light 18 causes the translucent pail body 12 to glow as if a candle were lighted inside the pumpkin, provides a small amount of light to illuminate the ground below, and provides a highly visible, lighted safety indicator for passing vehicles. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An illuminated toy pail comprising:

a translucent pail body having a bottom wall and an upwardly extending sidewall, said bottom wall and said sidewall cooperating to define an interior space, said sidewall having an upper peripheral edge which defines an opening in a top portion of the pail body;

a handle attached to the upper peripheral edges of the sidewall whereby the pail body hangs generally below the handle in use thereof;

a chemical light stick; and a light stick retainer located on an inner surface of the bottom wall of the pail body, said retainer including an upwardly extending retainer wall, said retainer wall defining a vertical bore with an open top end for receiving the light stick therein in a generally vertical orientation within the interior space of the pail body, said chemical light stick being exposed within the interior space of the pail body;

wherein the chemical light stick has a cylindrical end portion which is receivable within said bore, said retainer wall including radially inwardly extending ridges which are circumferentially spaced around an interior surface of said bore, said ridges frictionally engaging the cylindrical end portion of the chemical light stick when received within said bore.

2. A toy pail comprising:

a translucent pail body having a bottom wall and an upwardly extending sidewall, said bottom wall and said sidewall cooperating to define an interior space, said bottom wall including an opening therein, said sidewall having an upper peripheral edge which defines an opening in a top portion of the pail body;

a handle attached to the upper peripheral edges of the sidewall whereby the pail body hangs generally below the handle in use thereof; and a retainer including a bottom portion and a top portion, said bottom portion of said retainer including a formation which is snap-received within the opening in the bottom wall of the pail body, an upper flange for engaging an inner surface of the bottom wall, and a press-fit flange having a lip which is press-fit through the opening in the bottom wall and engages the outer surface of the bottom wall, said top portion of said retainer including a retainer wall defining a vertical bore with an open top end for receiving a chemical light stick therein in a generally vertical orientation within the interior space of the pail body, said retainer wall including radially inwardly extending ridges which are circumferentially spaced around an interior surface of said bore, said ridges frictionally engaging an end portion of the chemical light stick when received within said bore, said light stick being exposed within the interior space of the pail body.

3. An illuminated toy pail comprising:

a translucent pail body having a bottom wall and an upwardly extending sidewall, said bottom wall and said sidewall cooperating to define an interior space, said bottom wall including an opening therein, said sidewall having an upper peripheral edge which defines an opening in a top portion of the pail body;

a handle attached to the upper peripheral edges of the sidewall whereby the pail body hangs generally below the handle in use thereof;

a chemical light stick; and a light stick retainer including a bottom portion and a top portion, said bottom portion of said retainer including a formation which is snap-received within the opening in the bottom wall of the pail body, an upper flange for engaging an inner surface of the bottom wall, and a press-fit flange having a lip which is press-fit through the opening in the bottom wall and engages the outer surface of the bottom wall, said top portion of said retainer including a retainer wall defining a vertical bore with an open top end for receiving a chemical light stick therein in a generally vertical orientation within the interior space of the pail body, said retainer wall including radially inwardly extending ridges which are circumferentially spaced around an interior surface of said bore, said ridges frictionally engaging an end portion of the chemical light stick when received within said bore, said light stick being exposed within the interior space of the pail body.

* * * * *